US005155469A

United States Patent [19]

Hartmann et al.

[11] Patent Number: 5,155,469

[45] Date of Patent: Oct. 13, 1992

[54] WIRELESS ALARM SYSTEM

[75] Inventors: Jon P. Hartmann, Santa Ana; Ted W. Glasener, Orange, both of Calif.

[73] Assignee: Honeywell, Inc., Minneapolis, Minn.

[21] Appl. No.: 683,474

[22] Filed: Apr. 9, 1991

Related U.S. Application Data

[63] Continuation of Ser. No. 454,327, Dec. 21, 1989, abandoned.

[51] Int. Cl.[5] ..... G08B 1/08

[52] U.S. Cl. ..... 340/539; 340/531; 455/49.1; 455/65

[58] Field of Search ..... 340/539, 531; 455/63, 455/65, 49-51, 56, 59, 60, 61

[56] References Cited

U.S. PATENT DOCUMENTS

| | | | |
|---|---|---|---|
| 4,101,872 | 7/1978 | Pappas | 340/539 |
| 4,232,308 | 11/1980 | Lee et al. | 340/539 |
| 4,442,426 | 4/1984 | Heuschmann et al. | 340/539 |
| 4,661,804 | 4/1987 | Abel | 340/539 |
| 4,734,680 | 3/1988 | Gehmann et al. | 340/539 |

*Primary Examiner*—Donnie L. Crosland

*Attorney, Agent, or Firm*—Robert B. Leonard; Donald J. Lenkszus

[57] ABSTRACT

In a wireless alarm system an arrangement for increasing the reliability that messages will be received is provided. Each transmitter transmits an alarm message a plurality of times with delays between the messages. Successive delay times are of different duration to increase the likelihood that messages will not be lost if two transmitters transmit at the same time.

6 Claims, 3 Drawing Sheets

WIRELESS ALARM SYSTEM

This application is a continuation of application Ser. No. 07/454,327 filed Dec. 21, 1989, now abandoned.

BACKGROUND OF THE INVENTION

This invention pertains, in general, to commercial and residential security and fire alarm systems and the like and, in particular to an arrangement for transmitting messages from alarm sensors to a control panel or the like.

One example of a residential or home alarm system is the Honeywell System 2000 Home Security System available from the Protection Services Division of Honeywell Inc. This system includes a control panel board to which a home security panel may be connected. The system can with an RF (radio frequency) receiver option support in addition up to seven hardwired loops and up to 94 RF transmitter points.

The RF transmitters may be coupled to alarm sensors such as magnetic door or window contacts or infrared motion detectors to send messages from the alarm sensors to the control panel board. Short range FM (frequency modulation) pulsed data cycle transmissions are utilized which in the United States are authorized by the Federal Communications Commission under Part 15 of the FCC regulations in a frequency range centered at approximately 315 mHz.

A typical alarm installation contains several RF transmitters. Each transmitter, if reporting an alarm condition, will transmit its message a plurality, e.g., six, times to increase the likelihood that the message will be received. There is, however, a possibility that in the event multiple transmitters transmit messages at approximately the same time, one alarm condition message may not be received due to overlap of the transmitted messages.

SUMMARY OF THE INVENTION

In accordance with the principles of the invention the possibility that transmissions can be lost is significantly reduced by transmitting a message a plurality of times but delaying each message transmission by a time period such that the successive delay time periods are not of the same duration.

Further, in accordance with the principles of the invention, in the illustrative embodiment of the invention, the time duration of each alarm message is substantially uniform, but the successive delays between alarm messages is in a staggered non-uniform pattern.

BRIEF DESCRIPTION OF THE DRAWINGS

The invention may be better understood from a reading of the following detailed description in conjunction with the drawing in which.

DETAILED DESCRIPTION

Figure 1:
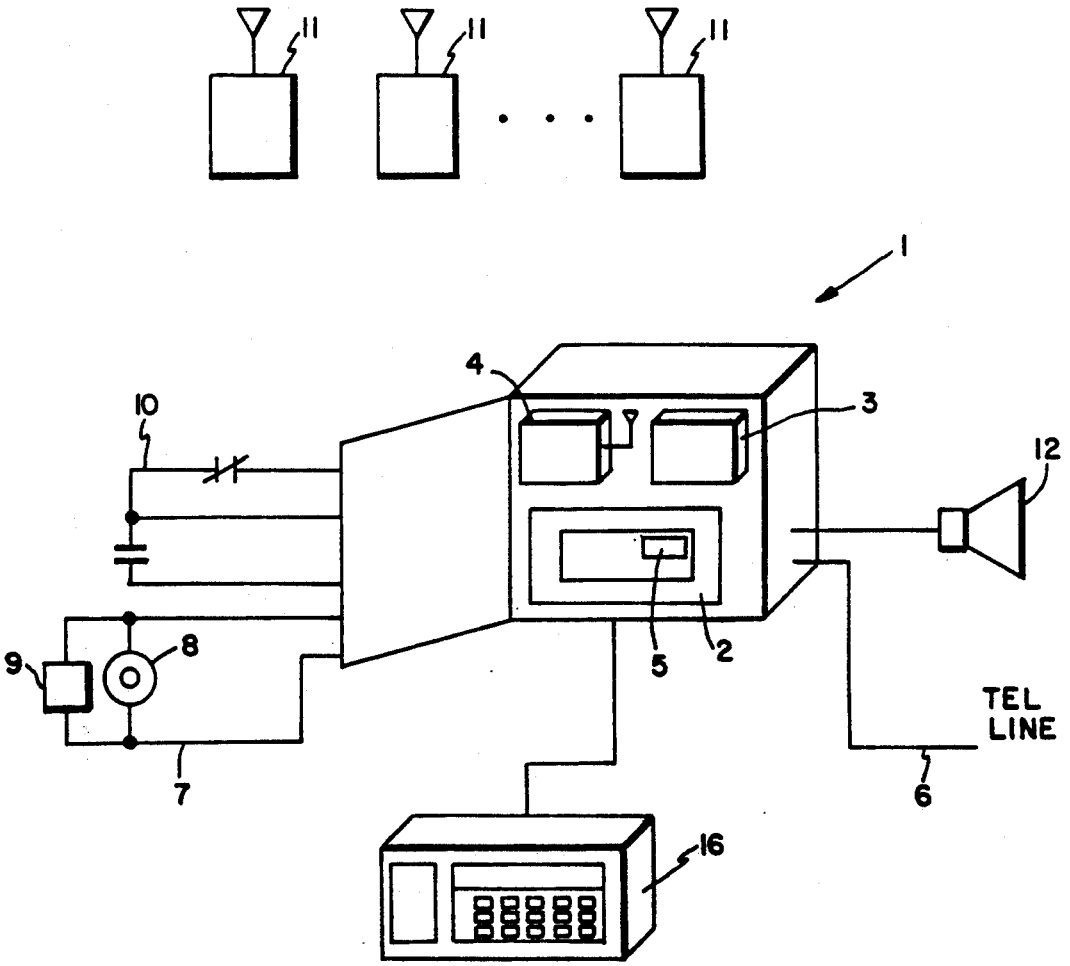
FIG. 1 illustrates an alarm system in which the principle of the invention may be advantageously employed.

Typical components of an alarm system are shown in FIG. 1.

A control panel 1 includes a control board 2, power supply and battery 3 and an RF receiver 4. A digital dialer 5 is incorporated which can send an account number plus loop number, alarm, trouble and restore messages to a central station receiver via telephone lines 6. The system can accommodate up to seven hardwired loops, including a fire loop 7 which can accommodate a maximum of five smoke detectors 8. The fire loop 7 includes an end of line module 9. Additional hardwire loops 10 may be used for alarm functions and are one of the normally opened and normally closed types as are typical for such systems. In addition to the hardwired loops, up to 94 RF transmitter point ID numbers can be utilized. Typically, each RF transmitter 11 (which may for example, be a wall mount or hand held transmitter) is assigned its own ID number in the system. Additionally, an audible alarm such as a horn 12 or bell may be connected to the alarm system. A control panel 16 is provided for the system user to activate/deactivate the security and other aspects of the system.

Figure 2:
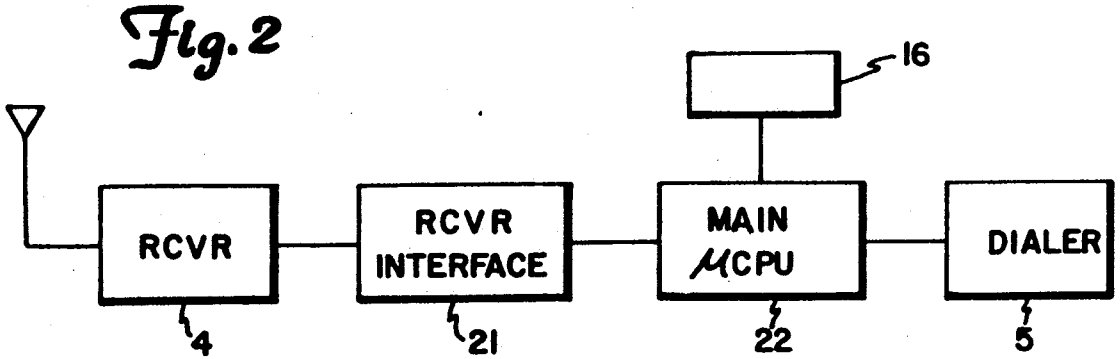
FIG. 2 is a block diagram of an alarm system utilizing the present invention.

Turning now to FIG. 2, the control board 2 includes a receiver interface 21 having inputs connected to the RF receiver 4. The receiver interface 21 in turn has outputs connected to a main microprocessor unit 22 which in turn controls the operation of dialer 5.

Figure 3:
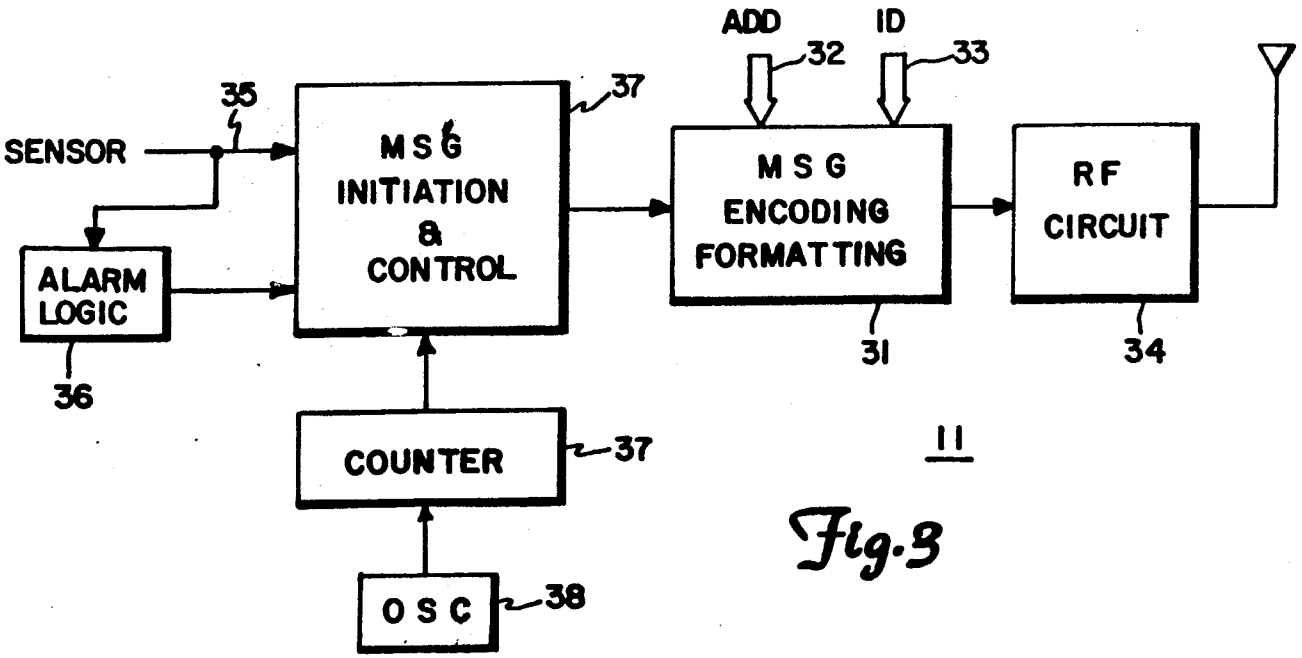
FIG. 3 is a functional block diagram of a transmitter of FIG. 1.

Each transmitter 11 is shown in greater detail in FIG. 3. Each transmitter within the system is assigned an identification address which may typically be set by switches. The receiver to which the messages are to be transmitted is also identified by an address.

The address of the receiver is provided to a message encoding and formatting circuit 31 via inputs 32. Likewise, the identification address of the transmitter 11 is provided to circuit 31 via inputs 33. The message encoding and formatting circuit 31 serves to selectively activate RF circuit 34 and to provide message block information to the RF circuit 34 for modulation of the FM signal generated. The transmitter 11 has sensor inputs 35 which are coupled directly to alarm logic 36 and a message initiation and control logic block 37. A conventional oscillator 38 serves to drive a counter and timing circuit 39 which provides various time base signals including automated test message timing signals used in the operation of the transmitter.

The message initiation and control logic 37 is used to control the process of message transmission. Message transmission is required under different circumstances depending upon the function of the transmitter such as, for example, a transistor occurrence at sensor input 35 or an automated test message timing signal from counter 37. Message transmission is performed by initiating a message transmission cycle.

Figure 5:
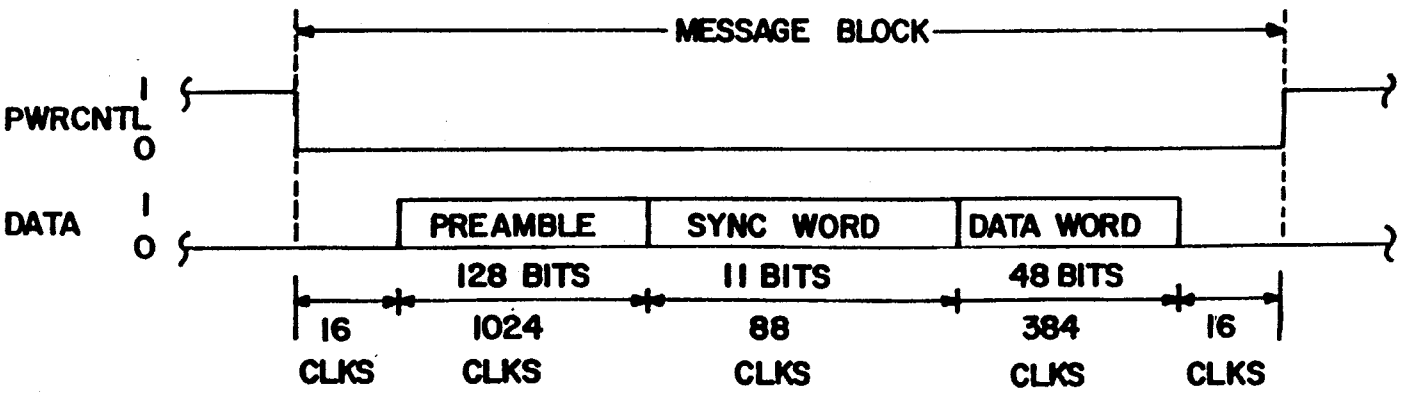
FIG. 5 illustrates the format of messages transmitted.

When a message transmission cycle is initiated by the message initiator and control logic 37, the message encoding and formatting circuit 31 will generate a message block in accordance with the format illustrated in FIG. 5.

Figure 4:
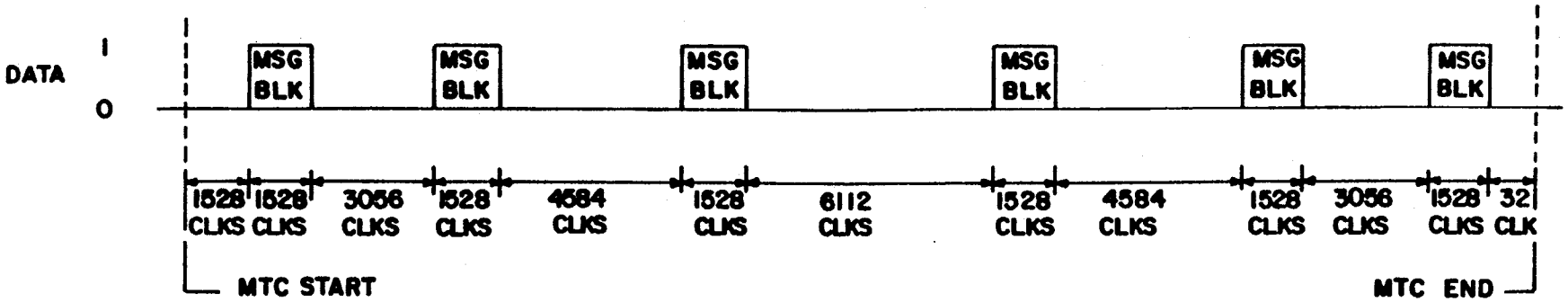
FIG. 4 is a timing diagram.

When a message is to be transmitted, the message encoding and formatting circuit 31 enables or turns power on to the RF circuit 34 (see FIG. 3) and provides message blocks thereto in accordance with the timing diagram of FIG. 4.

As is apparent from FIG. 4, if 1528 clock cycles is considered to be one time unit, then each message block is one time unit in duration and the number of successive time delays between messages in FIG. 4 is 2, 3, 4, 3, 2. Thus, the delay periods between successive messages is not uniform. It has been found that utilizing this technique results in significantly less likelihood that when two transmitters are transmitting at the same time a message from one will not be received.

In one prior arrangement over which the present invention is an improvement, three message blocks would be sent with no significant delay between message blocks and the receiver would compare each received message block and generate an output only if two identical messages were detected.

In accordance with the present arrangement each message block contains error detectors and correction information, i.e., priority.

What is claimed is:

1. In an alarm system comprising at least one transmitter, a receiver and means for initiating transmission of coded messages from said transmitter; an improved method for transmitting said coded messages, said method including the steps of:

transmitting each said coded message a predetermined number of times;

delaying the transmission of each of successive transmitted messages by one of a plurality of predetermined delay times from a prior transmitted message, successive predetermined delay times not being of equal time duration and having a fixed predetermined relationship to the time duration of each coded message.

2. The alarm system of claim 1 wherein said predetermined number of times is 6.

3. The alarm system of claim 2 where T is a time duration of each coded message and D X,Y equals a delay time between successive messages where X=1 to 5 and Y=2 to 6, and where said predetermined relationship between said messages and predetermined delay times is

D1, 2=2T
D2, 3=3T
D3, 4=4T
D4, 5=3T
D5, 6=2T.

4. Alarm system comprising:

at least one transmitter for transmitting coded messages;

at least one alarm system receiver for receiving said coded messages;

each said transmitter including:

means for transmitting each said coded message a predetermined number of times; and means for delaying the transmission of each successive transmitted messages by one of a plurality of predetermined delay times from a prior transmitted message, successive predetermined delay times not being of equal duration and having a fixed predetermined relationship to the time duration of each coded message.

5. The alarm system of claim 4 wherein said predetermined number of times is 6.

6. The alarm system of claim 5 where T is a time duration of each coded message and D X,Y equals a delay between successive messages where X=1 to 5 and Y=2 to 6, and where said predetermined relationship between said messages and predetermined delay times is:

D1, 2=2T
D2, 3=3T
D3, 4=4T
D4, 5=3T
D5, 6=2T.

* * * * *